US006052138A

United States Patent [19]

Kojima

[11] Patent Number: 6,052,138

[45] Date of Patent: Apr. 18, 2000

[54] SHADING COMPENSATION METHOD

[75] Inventor: Tetsuya Kojima, Kanagawa, Japan

[73] Assignee: Fuji Photo Film Co., Ltd., Kanagawa, Japan

[21] Appl. No.: 08/987,379

[22] Filed: Dec. 9, 1997

[30] Foreign Application Priority Data

Dec. 9, 1996 [JP] Japan ..... 8-328224

[51] Int. Cl.[7] ..... B41J 2/36

[52] U.S. Cl. ..... 347/188; 347/183; 347/184

[58] Field of Search ..... 347/188, 183, 347/184; 400/120.07, 120.09; 358/461

[56] References Cited

U.S. PATENT DOCUMENTS 5,796,420 8/1998 Kaerts et al. ..... 347/188
5,886,724 3/1999 Kuwabara et al. ..... 347/188

FOREIGN PATENT DOCUMENTS 9-234899 9/1997 Japan ..... 347/188

*Primary Examiner*—Huan Tran

*Attorney, Agent, or Firm*—Sughrue, Mion, Zinn, Macpeak & Seas, PLLC

[57] ABSTRACT

In the improved shading compensation method applied to thermal recording for recording on a thermal recording material by using a thermal head having a glaze in which heat-generating elements are arranged in one direction, and by relatively moving the glaze and the thermal recording material in a direction perpendicular to the direction in which the heat-generating elements are arranged, with the thermal recording material being kept in contact with the glaze, a plurality of shading compensation tables corresponding to different recording densities are used and the weights of the plurality of shading compensation tables are changed in accordance with the recording densities, to thereby calculate conditions for shading compensation. In thermal recording making use of a thermal head, this shading compensation method is always capable of performing suitable shading compensation irrespective of the recording density and the recording position in the auxiliary scanning direction, to thereby realize a thermal recording apparatus in which high-quality images can be recorded in a consistent manner.

6 Claims, 3 Drawing Sheets

SHADING COMPENSATION METHOD

BACKGROUND OF THE INVENTION

This invention relates to the art of shading compensation method in thermal recording using a thermal head.

Thermal recording materials comprising a thermal recording layer on a substrate of a film or the like, which are hereunder referred to as thermal materials, are commonly used to record images produced in diagnosis by ultrasonic scanning.

This recording method, also referred to as thermal recording, eliminates the need for wet processing applied to the image recording which involves the use of silver halide photosensitive materials such as an X-ray film and offers several advantages including convenience in handling. Hence in recent years, the use of the thermal recording is not limited to small-scale applications such as diagnosis by ultrasonic scanning and an extension to those areas of medical diagnoses such as CT, MRI and X-ray photography where large and high-quality images are required is also under review.

As is well known, thermal recording involves the use of a thermal head having a glaze in which heat-generating elements for heating the thermal recording layer of a thermal material to record an image are arranged in one direction (main scanning direction) and, the thermal material or the thermal head is scanned and transported in the auxiliary scanning direction perpendicular to the direction in which the glaze extends, with the glaze a little pressed against the thermal material (thermal recording layer). The thermal head and the thermal material are hence relatively moved in the auxiliary scanning direction and the respective heat-generating elements of the glaze are actuated imagewise by energy application to heat the thermal recording layer of the thermal material, thereby accomplishing image reproduction.

These types of thermal recording have a common problem in that even if it is attempted to perform image recording at uniform density, individual recording apparatuses have their own peculiar characteristics which cause uneven image densities in the main scanning direction. This phenomenon is commonly called "shading" and deteriorates the quality of the recorded image.

For example, the shape of the glaze on the thermal head is not uniform throughout all pixels, but scatters unavoidably; therefore, even if the respective heat-generating elements are supplied with the same amount of energy, they will generate different amounts of heat, causing "shading" or unevenness in the density of the image being recorded.

In order to prevent the deterioration in image quality due to "shading", the thermal recording apparatus having the object of providing high-quality images is adapted to perform "shading compensation", in which the unevenness in image density due to shading is corrected. A typical procedure of shading compensation is as follows. First, image recording is performed on the basis of image data having uniform density in the main scanning direction; the densities of the recorded image are measured and with a certain pixel, say, one of a minimal density, being taken as a reference, the shading compensation data (compensation conditions) which will provide a uniform image density for all pixels are calculated for the respective pixels and shading compensation tables are prepared comprising the respective pixels and shading compensation data. Shading compensation in actual thermal recording is performed by compensating the image data from its supply source by means of the shading compensation data read out of the shading compensation tables.

The inventor has made investigations and found that the shading properties of thermal recording often vary with the recording density and the position on the thermal material in the auxiliary scanning direction.

As described above, thermal recording is performed by heating imagewise the respective heat-generating elements, with the glaze of the thermal head being pressed against the thermal recording layer. Therefore, the temperature of the heat-generating elements varies with the image density, irrespective of whether recording is performed by pulse-width (pulse-number) modulation, or intensity modulation. Thus, the shading properties also vary with the temperature, that is, the recording density.

Thermal recording is performed by scanning the thermal head and the thermal material in the auxiliary direction, as described above. Hence, heat is gradually transmitted from the recording start position toward the end position on a sheet of thermal material to be recorded. In consequence, density gradient is generated between the start and end positions, which gives rise to a variation in the shading properties depending on the recording position in the auxiliary scanning direction.

The conventional shading compensation method as described above can not follow the variation in the shading properties depending on the recording density and recording position. Particularly in applications such as the medical application which require high-quality images, in some cases the thermal recording images having a desired image quality can not be obtained in a consistent manner.

SUMMARY OF THE INVENTION

The present invention has been accomplished under these circumstances and has as an object providing a shading compensation method, in thermal recording using a thermal head, which is always capable of performing suitable shading compensation irrespective of the recording density or the recording position in the auxiliary scanning direction so that high-quality images can be recorded consistently.

In order to achieve the above object, in a first embodiment of the invention, there is provided a shading compensation method applied to thermal recording for recording on a thermal recording material by using a thermal head having a glaze in which heat-generating elements are arranged in one direction, and by relatively moving said glaze and said thermal recording material in a direction perpendicular to the direction in which said heat-generating elements are arranged, with the thermal recording material being kept in contact with said glaze, wherein a plurality of shading compensation tables corresponding to different recording densities are used and the weights of said plurality of shading compensation tables are changed in accordance with the recording densities, to thereby calculate conditions for shading compensation.

In a second embodiment of the invention, there is also provided a shading compensation method applied to thermal recording for recording on a thermal recording material by using a thermal head having a glaze in which heat-generating elements are arranged in one direction, and by relatively moving said glaze and said thermal recording material in a direction perpendicular to the direction in which said heat-generating elements are arranged, with the thermal recording material being kept in contact with said glaze, wherein a plurality of shading compensation tables corresponding to different positions in the direction in which said glaze and said thermal recording material are relatively moved are used, and the weights of said plurality of shading compensation tables are changed in accordance with the recording positions in said moving direction, to thereby calculate conditions for shading compensation.

In a third embodiment of the invention, there is further provided a shading compensation method applied to thermal recording for recording on a thermal recording material by using a thermal head having a glaze in which heat-generating elements are arranged in one direction, and by relatively moving said glaze and said thermal recording material in a direction perpendicular to the direction in which said heat-generating elements are arranged, with the thermal recording material being kept in contact with said glaze, wherein a plurality of shading compensation tables corresponding to different recording densities as well as a plurality of shading compensation tables corresponding to different positions in the direction in which said glaze and said thermal recording material are relatively moved are used, and the weights of said plurality of shading compensation tables are changed in accordance with the recording densities or the recording positions in said moving direction, to thereby calculate conditions for shading compensation.

In the first, second and third embodiments of the shading compensation method of the invention, said weights are preferably changed by linearly interpolating between said shading compensation tables.

DETAILED DESCRIPTION OF THE INVENTION

The shading compensation method of the invention will now be described in detail with reference to the preferred embodiments shown in the accompanying drawings.

Figure 1:
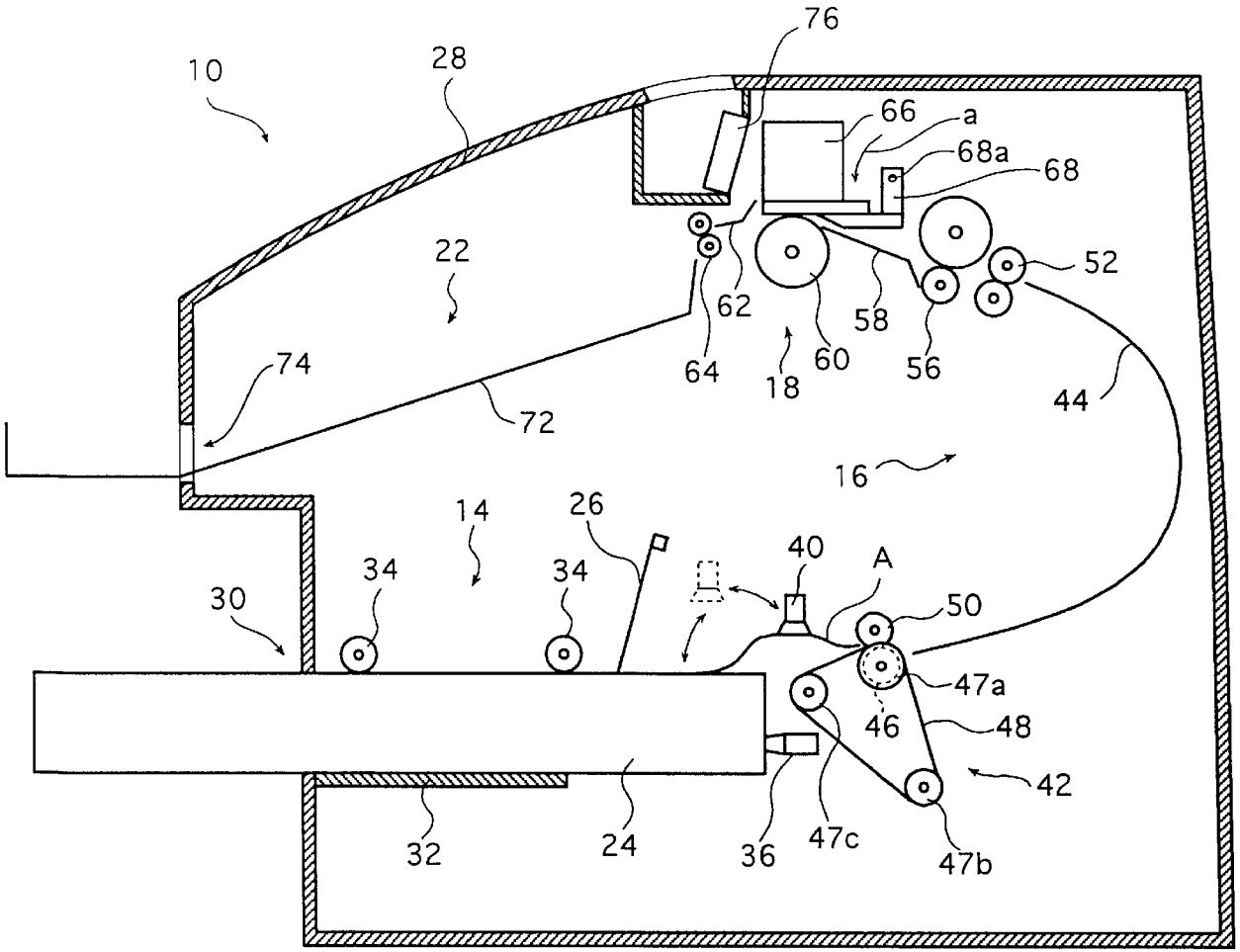
FIG. 1 is a diagram showing the concept of an exemplary thermal recording apparatus to which the shading compensation method of the invention is applied.

FIG. 1 shows schematically the concept of an exemplary thermal recording apparatus to which the shading compensation method of the invention is applied.

The thermal recording apparatus generally indicated by 10 in FIG. 1 and which is hereunder simply referred to as a "recording apparatus 10" performs thermal recording on thermal materials comprising a thermal recording layer on the one entire surface of a substrate such as a resin film or paper. In the illustrated case, are used in an example thermal materials A comprising a substrate of a transparent polyethylene terephthalate (PET) film which is overlaid with a thermal recording layer. This material is hereunder referred to as "thermal materials A".

The recording apparatus 10 comprises a loading section 14 where a magazine 24 containing thermal materials is loaded, a feed/transport section 16, a recording section 18 performing thermal recording on thermal materials by means of the thermal head 66, and an ejecting section 22.

Figure 2:
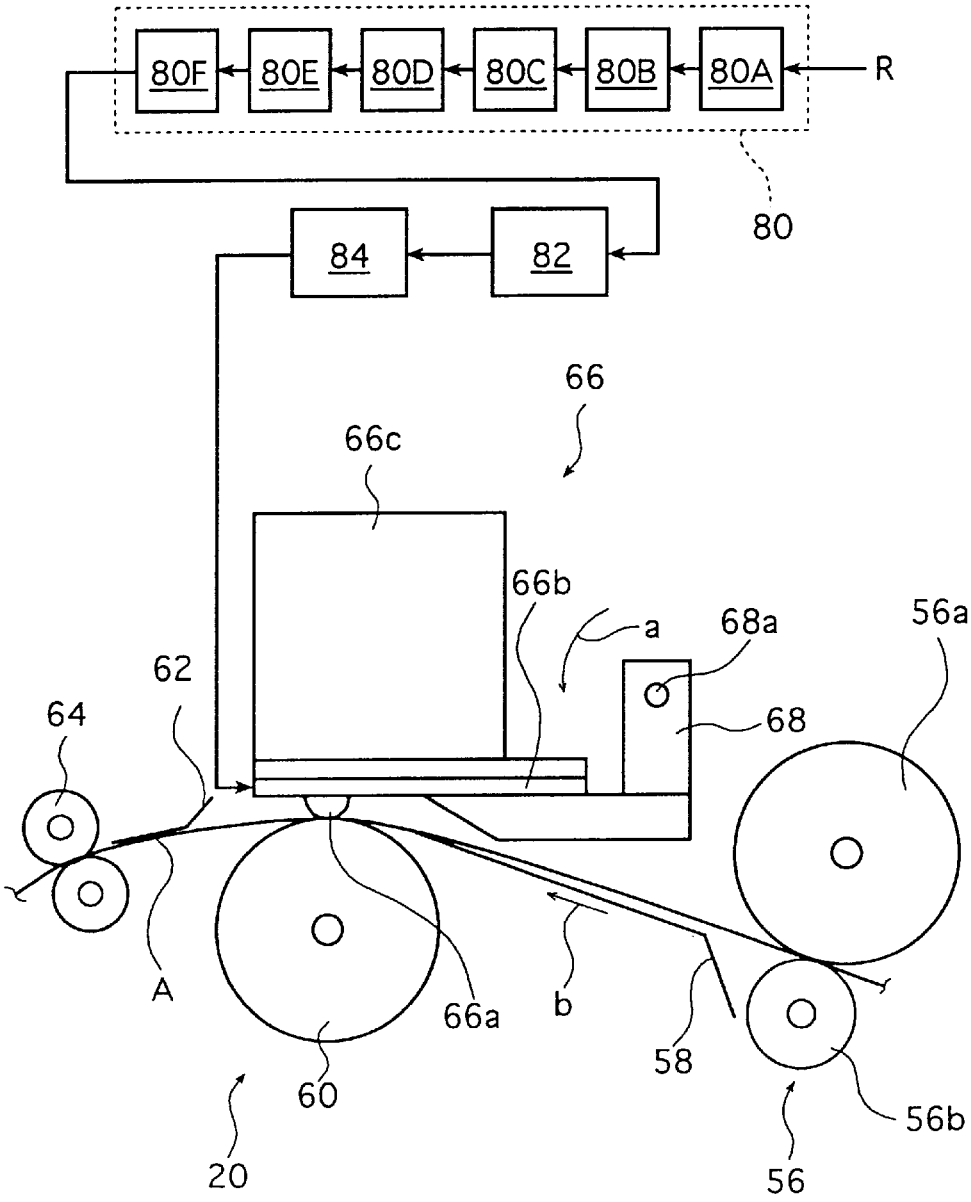
FIG. 2 shows the concept of the recording section of the thermal recording apparatus shown in FIG. 1.

In addition, as shown in FIG. 2, the thermal head 66 in the recording section 18 is connected to an image processing unit 80 which performs a variety of image processing operations including the shading compensation of the invention, an image memory 82 and a recording control unit 84.

In the thus constructed recording apparatus 10, the feed/transport section 16 transports the thermal material A to the recording section 18, where the thermal material A against which the thermal head 66 is pressed is transported in the auxiliary scanning direction perpendicular to the main scanning direction in which the glaze extends (normal to the papers of FIGS. 1 and 2) and in the meantime, the respective heat-generating elements are actuated imagewise to form color on the thermal material A, thereby performing thermal recording.

In the illustrated example, thermal materials A are cut sheets of a given size, for example B4.

Typically, such thermal materials A are stacked in a specified number, say, 100 to form a bundle, which is either wrapped in a bag or bound with a band to provide a package. As shown, the specified number of thermal materials A bundled together with the thermal recording layer side facing down are accommodated in the magazine 24 of the recording apparatus 10, and they are taken out of the magazine 24 one by one to be used for thermal recording.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The feed/transport section 16 has the sheet feeding mechanism using the sucker 40 for grabbing the thermal material A by application of suction, transport means 42, a transport guide 44 and a regulating roller pair 52 located in the outlet of the transport guide 44; the thermal materials A are taken out of the magazine 24 in the loading section 14 and transported to the recording section 18.

The transport means 42 comprises a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46. The forward end of the thermal material A which has been sheet-fed by means of the sucker 40 is pinched between the transport roller 46 and the nip roller 50 such that the material A is transported.

When a signal for the start of recording is issued, the cover 26 is opened by the OPEN/CLOSE mechanism (not shown) in the recording apparatus 10. Then, the sheet feeding mechanism using the sucker 40 picks up one sheet of thermal material A from the magazine 24 and feeds the forward end of the sheet to the transport means 42 (to the nip between rollers 46 and 50). At the point of time when the thermal material A has been pinched between the transport roller 46 and the nip roller 50, the sucker 40 releases the material, and the thus fed thermal material A is supplied by the transport means 42 into the regulating roller pair 52 as it is guided by the transport guide 44.

At the point of time when the thermal material A to be used in recording has been completely ejected from the magazine 24, the OPEN/CLOSE mechanism closes the cover 26.

The distance between the transport means 42 and the regulating roller pair 52 which is defined by the transport guide 44 is set to be somewhat shorter than the length of the thermal material A in the direction of its transport. The forward end of the thermal material A first reaches the regulating roller pair 52 by the transport means 42. The regulating roller pair 52 are first at rest. The forward end of the thermal material A stops here and is subjected to positioning.

When the forward end of the thermal material A reaches the regulating roller pair 52, the temperature of the thermal head 66 (glaze 66*a*) is checked and if it is at a specified level, the regulating roller pair 52 start to transport the thermal material A, which is transported to the recording section 18.

FIG. 2 shows schematically the recording section 18.

The recording section 18 has the thermal head 66, a platen roller 60, a cleaning roller pair 56, a guide 58, a fan 76 for cooling the thermal head 66 (see FIG. 1) and a guide 62, as well as the image processing unit 80, the image memory 82 and the recording control unit 84 constituting a recording control system.

The thermal head 66 is capable of thermal recording at a recording (pixel) density of, say, about 300 dpi on thermal films for example up to B4 size. The thermal head 66 comprises a body 66*b* having the glaze 66*a* in which in total 3072 heat-generating elements performing thermal recording on the thermal material A are arranged in one direction, that is, in the main scanning direction, and a heat sink 66*c* fixed to the body 66*b*. The thermal head 66 is supported on a support member 68 that can pivot about a fulcrum 68*a* either in the direction of arrow a or in the reverse direction.

The platen roller 60 rotates at a specified recording speed while holding the thermal material A in a specified position, and transports the thermal material A in the auxiliary scanning direction (direction of arrow b in FIG. 2) perpendicular to the main scanning direction.

The cleaning roller pair 56 consists of an adhesive rubber roller 56*a* made of an elastic material and a non-adhesive roller 56*b*. The adhesive rubber roller 56*a* picks up dirt and other foreign matter that has been deposited on the thermal recording layer in the thermal material A, thereby preventing the dirt from being deposited on the glaze 66*a* or otherwise adversely affecting the recording operation.

Before the thermal material A is transported to the recording section 18, the support member 68 in the illustrated recording apparatus 10 has pivoted to UP position (in the direction opposite to the direction of arrow a) so that the thermal head 66 (or glaze 66*a*) is not in contact with the platen roller 60.

When the transport of the thermal material A by the regulating roller pair 52 starts, said material is subsequently pinched between the cleaning roller pair 56 and transported as it is guided by the guide 58. When the forward end of the thermal material A has reached the record START position (i.e., corresponding to the glaze 66*a*), the support member 68 pivots in the direction of arrow a and the thermal material A becomes pinched between the glaze 66*a* on the thermal head 66 and the platen roller 60 such that the glaze 66*a* is pressed onto the recording layer while the thermal material A is transported in the direction indicated by arrow b by means of the platen roller 60 (as well as the regulating roller pair 52 and the transport roller pair 64) as it is held in a specified position.

During this transport, the respective heat-generating elements on the glaze 66*a* are actuated imagewise to perform thermal recording on the thermal material A.

As described above, the system for controlling the recording with the thermal head 66 comprises essentially the image processing unit 80, the image memory 82 and the recording control unit 84.

Image data (image information) from an image data supply source R such as CT or MRI are sent to the image processing unit 80, which is the combination of various kinds of image processing circuits and memories.

The image data supplied from the image data supply source R are first sent to a processing portion (not shown) for the necessary formatting (scaling and frame assignment); thereafter, the image data are sent to a sharpness correcting portion 80A, where they are subjected to sharpness correction for enhancing the edges of an image (sharpness processing); then, the image data are sent to a tone correcting portion 80B, where they are not only subjected to tone correction for producing an appropriate image in compliance with associated parameters such as the γ value of the thermal material A, but also transformed to image data that comply with the drive of the thermal head 66 by the recording control unit 84; then, the image data are sent to a temperature compensating portion 80C, where they are subjected to temperature compensation for adjusting the heat generating energy in accordance with the temperatures of heat-generating elements; then, the image data are sent to a shading compensating portion 80D, where they are subjected to shading compensation; then, the image data are sent to a resistance correcting portion 80E, where they are subjected to resistance correction for correcting the difference between the resistance values of the respective heat-generating elements; finally, the image data are sent to a black ratio correcting portion 80F, where they are subjected to black ratio correction such that image data representing the same density will produce a color of identical density irrespective of the change in the resistance values of heat-generating elements due to heating. Having been subjected to these steps of correction, the image data are delivered to the image memory 82 as output image data for use in thermal recording by the thermal head 66.

In the case under consideration, the shading compensating portion 80D is a portion in which shading compensation is performed according to the first embodiment of the shading compensation method of the invention.

As already mentioned, it is difficult to ensure that the shape of the glaze 66*a* on the thermal head 66 is uniform throughout all pixels and a certain amount of scattering usually occurs from one pixel to another. In addition, the amount of heat generated by the respective heat-generating elements is variable in the direction in which the glaze 66*a* extends. Therefore, even if thermal recording is performed using image data which represent the same density, shading, or uneven densities, occur on account of such scattering in the shape of the glaze or the positional variation.

The recording apparatus 10 corrects such unevenness in density by performing shading compensation in the shading compensating portion 80D of the image processing unit 80.

Shading compensation is typically performed in the following way: first, heat energy for image data of a specified density is supplied to all pixels (heat-generating elements) of the thermal head 66 to form an image by actual thermal recording and the density of the recorded image is measured by a suitable means such as a densitometer; then, with a certain pixel, say, one of a minimal density, being taken as a reference, shading compensation data for performing shading compensation (hereunder referred to as compensation data) are calculated for each pixel such that the density of the thermal image to be recorded is made uniform throughout the all pixels and stored as shading compensation tables in the shading compensating portion 80D, where shading compensation is performed in the actual process of thermal recording by processing the image data by means of the compensation data.

The shading compensating portion 80D of the invention comprises a plurality of shading compensation tables corresponding to different recording densities, in the illustrated case, two shading compensation tables corresponding to different recording densities including a shading compensation table as calculated for high density image recording and a shading compensation table as calculated for low density image recording. The two shading compensation tables are used with the respective weights being changed in accordance with the recording densities or image data to thereby calculate compensation data, which are then used for shading compensation.

For example, given that the compensation data of the shading compensation table for low density, the compensation data of the shading compensation table for high density and the compensation data as calculated using the two data are respectively $S_{L(i)}$, $S_{H(i)}$ and $S_{C(i)}$ in which i represents the pixel number, hence i=1 to 3072, the compensation data $S_{Ci}$ are calculated by the following expression.

$$S_{C(i)}=aS_{L(i)}+bS_{H(i)}$$

where a and b are weighting coefficients and a+b=1. The weighting coefficients are changed depending on the image density, that is, image data. Thus, "b" takes a larger value when high density image is to be recorded in the pixel i, whereas "a" takes a larger value in a low density image recording.

In the invention, the respective compensation data of the shading compensation tables are linearly interpolated to change the weight to thereby calculate the compensation data.

Figure 3:
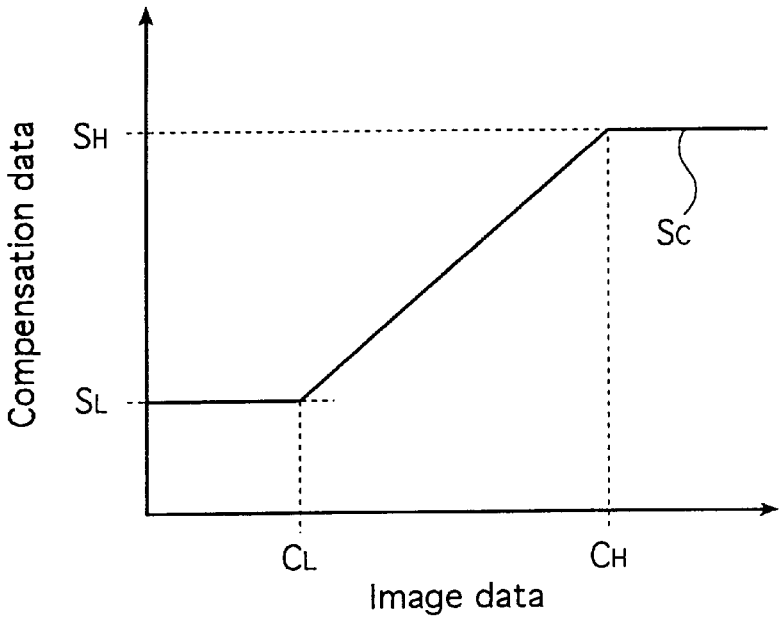
FIG. 3 is a graph illustrating an embodiment of the shading compensation method of the invention.

More specifically, given that the image data of an image recorded to calculate the compensation data for low density $S_{L(i)}$, the image data of an image recorded to calculate the compensation data for high density $S_{H(i)}$, the image data of the pixel i, and the image data of the pixel i subjected to shading compensation are $C_L$, $C_H$, $D_{in(i)}$, $D_{out(i)}$, respectively, the compensation data $S_{C(i)}$ is calculated by linearly interpolating the compensation data $S_{L(i)}$ and the compensation data $S_{H(i)}$, as shown in FIG. 3.

That is, when $D_{in(i)}<C_L$, $S_{C(i)}=S_{L(i)}$;

when $C_L \leqq D_{in(i)} \leqq C_H$, $$S_{C(i)}=[(D_{in(i)}-C_L)\times S_{H(i)}+(C_H-D_{in(i)}\times S_{L(i)}]/(C_H-C_L);$$

when $D_{in(i)}>C_H$, $S_{C(i)}=S_{H(i)}$;

In the shading compensating portion 80D, the thus calculated compensation data SC(i) are used for shading compensation according to the following expression.

$$D_{out(i)}=D_{in(i)}\times(1+S_{C(i)})$$

The number of the shading compensation tables is not limited to two, but more than two tables may be used. The shading compensation tables include preferably a shading compensation table for low density and a shading compensation table for high density.

The density is preferably in the range of about 0.2 to 1.0 for low level, and in the range of about 1.0 to 3.0 for high level.

In the case where at least three, for example three shading compensation tables are used, $S_{C(i)}$ may be calculated by the expression below when the weighting coefficients are to be changed in accordance with the density, and $S_{C(i)}$ may be calculated by linearly interpolating between the respective compensation data when the weights are to be changed by linear interpolation.

$$S_{C(i)}=aS_{L(i)}+bS_{H(i)}+cS_{M(i)}$$

where $S_{M(i)}$ is the compensation data for middle density.

As described above, image data processed in the image processing unit 80 are output to the image memory 82 where the image data are stored.

The recording control unit 84 reads the stored image data sequentially out of the image memory 82 line by line in the main scanning direction. The recording control unit 84 then supplies the thermal head 66 with image signals modulated in accordance with the thus read thermal recording image data (the duration of time for which voltage is applied imagewise) on the basis of the signal for heat generation which is a reference clock for heat generation.

The respective recording dots on the thermal head 66 generate heat in accordance with the received image signals and, as already described above, thermal recording is performed on the thermal material A as it is transported in the direction of arrow b by such means of transport as the platen roller 60.

After the end of thermal recording, the thermal material A as it is guided by the guide 62 is transported by the platen roller 60 and the transport roller pair 64 to be ejected into a tray 72 in the ejecting section 22. The tray 72 projects exterior to the recording apparatus 10 via the outlet 74 formed in the housing 28 and the thermal material A carrying the recorded image is ejected via the outlet 74 for takeout by the operator.

The first embodiment of the shading compensation method of the invention provides a method utilizing a plurality of shading compensation tables in accordance with the densities, whereas the second embodiment provides a method in which a plurality of shading compensation tables corresponding to the recording positions in the auxiliary scanning direction are used with the weights being changed in accordance with the recording positions to thereby calculate the compensation data, which are used to perform shading compensation.

For example, given that the compensation data of the shading compensation table prepared using a recorded image near the forward end (recording start side) of the thermal material A in the auxiliary scanning direction, the compensation data of the shading compensation table prepared using a recorded image near the rear end of the thermal material, and the compensation data calculated using the two data are $S_{top(i)}$, $S_{end(i)}$ and $S_{d(i)}$, respectively, the compensation data $S_{d(i)}$ is calculated by the following expression.

$$S_{d(i)}=aS_{top(i)}+bS_{end(i)}$$

where a and b are weighting coefficients and a+b=1. The weighting coefficients vary with the recording position in the auxiliary scanning direction. Thus, "b" takes a larger value when the recording position is near the rear end, whereas "a" takes a larger value when the recording position is near the forward end.

Also in this embodiment, the respective compensation data of the shading compensation tables are preferably linearly interpolated to change the weight to thereby calculate the compensation data.

Figure 4:
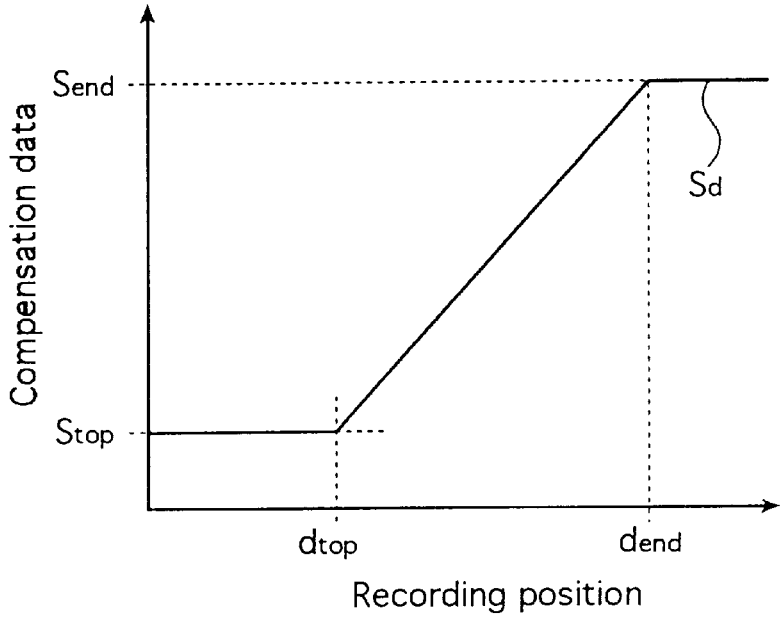
FIG. 4 is a graph illustrating another embodiment of shading compensation method of the invention.

More specifically, given that the position in the auxiliary scanning direction of an image recorded to calculate the compensation data near the forward end $S_{top(i)}$, the similar position of an image recorded to calculate the compensation data near the rear end, and the recording position of a recorded image in the auxiliary scanning direction are $d_{top}$, $d_{end}$ and d, respectively, the compensation data $S_{d(i)}$ is calculated by linearly interpolating the compensation data $S_{top(i)}$ and the compensation data $S_{end(i)}$, as shown in FIG. 4.

That is, when d is located nearer to the forward end than $d_{top}$, $S_{d(i)}=S_{top(i)}$;

when d is located between $d_{top}$ and $d_{end}$, $$S_{d(i)}=[(d-d_{top})\times S_{end(i)}+(d_{end}-d)\times S_{top(i)}]/(d_{end}-d_{top});$$

when d is located nearer to the read end than $d_{end}$, $S_{d(i)}=S_{end(i)}$;

The compensation data $S_{d(i)}$ is thus calculated to perform shading compensation in the same way as in said first embodiment.

The number of the shading compensation tables is not limited to two, but more than two tables may be used. The shading compensation tables include preferably a shading compensation table prepared near the forward end, and a shading compensation table prepared near the rear end.

The point "near the forward end" is preferably located about 0 to 15 cm, especially 0 to 5 cm away from the forward end in terms of the stability of the image density and the like. The point "near the rear end" is preferably located about 0 to 20 cm, especially 0 to 2 cm away from the rear end.

In the case where at least three, for example three shading compensation tables are used, the compensation data can be calculated in the same way as in said first embodiment.

In addition, the third embodiment of the shading compensation method of the invention provides a combined method of the shading compensation in the first embodiment of the invention and the shading compensation in the second embodiment of the invention.

Thus, image data are first subjected to the shading compensation according to the first embodiment which uses a plurality of shading compensation tables corresponding to different densities. The image data thus subjected to the shading compensation are subsequently subjected to the shading compensation according to the second embodiment which uses a plurality of shading compensation tables corresponding to different recording positions in the auxiliary scanning direction, before the shading compensation operation is completed. Both the shading compensation methods are as described above.

These shading compensations may be performed in the reverse order.

On the foregoing pages, the shading compensation method of the invention has been described in detail, but the present invention is in no way limited to the stated embodiments and various improvements and modifications can of course be made without departing from the spirit and scope of the invention.

As described above in detail, in thermal recording making use of a thermal head, the shading compensation method of the invention is always capable of performing suitable shading compensation irrespective of the recording density and the recording position in the auxiliary scanning direction, to thereby realize a thermal recording apparatus in which high-quality images can be recorded in a consistent manner.

What is claimed is:

1. A shading compensation method applied to thermal recording for recording on a thermal recording material by using a thermal head having a glaze in which heat-generating elements are arranged in one direction, and wherein said glaze and said thermal recording material are moved relatively in a direction perpendicular to said one direction, a moving direction, with the thermal recording material being kept in contact with said glaze, the method comprising the steps of:

determining recording densities from image data representing an image being recorded;

weighting a plurality of shading compensation tables corresponding to different recording densities in accordance with the recording densities; and calculating compensation data using said weighted shading compensation tables, where the compensation data is used for shading compensation.

2. A shading compensation method according to claim 1 wherein in said weighting step, weights given to said plurality of shading compensation tables are changed by linearly interpolating between said shading compensation tables.

3. A shading compensation method applied to thermal recording for recording on a thermal recording material by using a thermal head having a glaze in which heat-generating elements are arranged in one direction, and wherein said glaze and said thermal recording material are moved relatively in a direction perpendicular to said one direction, a moving direction, with the thermal recording material being kept in contact with said glaze, the method comprising the steps of:

determining recording positions of said glaze and said thermal recording material in said moving direction;

weighting a plurality of shading compensation tables corresponding to different positions in said moving direction, in accordance with the recording positions in said moving direction; and calculating compensation data using said weighted shading compensation tables, where the compensation data is used for shading compensation.

4. A shading compensation method according to claim 1 wherein in said weighting step, weights given to said plurality of shading compensation tables are changed by linearly interpolating between said shading compensation tables.

5. A shading compensation method applied to thermal recording for recording on a thermal recording material by using a thermal head having a glaze in which heat-generating elements are arranged in one direction, and wherein said glaze and said thermal recording material are moved relatively in a direction perpendicular to said one direction, a moving direction, with the thermal recording material being kept in contact with said glaze, the method comprising the steps of:

determining recording densities from image data representing an image being recorded;

determining recording positions of said glaze and said thermal recording material in said moving direction;

are relatively moved are used, and the weights of said plurality of shading compensation tables are changed in accordance with the recording positions in said moving direction; and weighting a plurality of shading compensation tables corresponding to different recording densities in accordance with the recording densities as well as weighting a plurality of shading compensation tables corresponding to different positions in said moving direction, in accordance with the recording positions in said moving direction; and calculating compensation data using said weighted shading compensation tables, where the compensation data is used for shading compensation.

6. A shading compensation method according to claim 1 wherein in said weighting step, weights given to said plurality of shading compensation tables are changed by linearly interpolating between said shading compensation tables.

* * * * *